United States Patent [19]

Yamada et al.

[11] Patent Number: 4,724,198

[45] Date of Patent: Feb. 9, 1988

[54] LIGHT-SENSITIVE SILVER HALIDE COLOR PHOTOGRAPHIC MATERIAL HAVING MULTI-LAYERED RED-SENSITIVE, GREEN-SENSITIVE AND BLUE-SENSITIVE EMULSION LAYERS

[75] Inventors: Yoshitaka Yamada; Toshifumi Iijima; Kenji Kumashiro; Takashi Kamio; Shinya Shimura, all of Hino, Japan

[73] Assignee: Konishiroku Photo Industry Co., Ltd., Tokyo, Japan

[21] Appl. No.: 942,025

[22] Filed: Dec. 15, 1986

Related U.S. Application Data

[63] Continuation of Ser. No. 605,571, Apr. 30, 1984, abandoned.

[30] Foreign Application Priority Data

May 6, 1983 [JP] Japan ..... 58-78288

[51] Int. Cl.[4] ..... G03C 1/46; G03C 7/26

[52] U.S. Cl. ..... 430/506; 430/226; 430/504; 430/505; 430/509; 430/538; 430/549; 430/553; 430/555; 430/557; 430/567; 430/941

[58] Field of Search ..... 430/505, 504, 506, 509, 430/567, 549, 941, 553, 557, 555, 538, 226

[56] References Cited

U.S. PATENT DOCUMENTS

| | | | |
|---|---|---|---|
| 3,658,536 | 4/1972 | Wolf | 430/506 |
| 3,663,228 | 5/1972 | Wyckoff | 430/506 |
| 4,129,446 | 12/1978 | Lohmann et al. | 430/507 X |
| 4,184,876 | 1/1980 | Eeles et al. | 430/505 |
| 4,267,264 | 5/1981 | Lohmann et al. | 430/505 |
| 4,446,226 | 5/1984 | Yamashita et al. | 430/567 X |
| 4,461,826 | 7/1984 | Yamashita et al. | 430/567 X |

FOREIGN PATENT DOCUMENTS 2138962 10/1984 United Kingdom .

*Primary Examiner*—John E. Kittle
*Assistant Examiner*—Mukund J. Shah
*Attorney, Agent, or Firm*—Frishauf, Holtz, Goodman & Woodward

[57] ABSTRACT

There is disclosed a light-sensitive silver halide color photographic material having red-sensitive, green-sensitive and blue-sensitive emulsion layers, each layer consisting of two or more layers with different sensitivities on a support, wherein the layers are constituted so as to satisfy the following requirements (A), (B), (C) and (D):

(A) of the respective emulsion layers having the highest sensitivities among the the red-sensitive, green-sensitive and blue-sensitive emulsion layers, the highest sensitivity blue-sensitive emulsion layer is provided on the side farthest from the support;

(B) at least the the highest sensitivity red-sensitive emulsion layer and the highest sensitivity green-sensitive emulsion layer are provided between the the highest blue-sensitive emulsion layer and a blue-sensitive emulsion layer with lower sensitivity;

(C) none of the respective red-sensitive, green-sensitive and blue-sensitive emulsion layers having the lowest sensitivities exists on the side farther than the low sensitivity blue-sensitive emulsion layer from the support; and (D) contained in at least one layer of the high sensitivity red-sensitive, green-sensitive and blue-sensitive layers, is a diffusion-resistant compound capable of forming a mobile dye through the coupling reaction with the oxidized product of a chromogenic developing agent.

The light-sensitive material according to this invention exhibits excellent photographic characteristics such as graininess, sharpness and sensitivity.

20 Claims, No Drawings

LIGHT-SENSITIVE SILVER HALIDE COLOR PHOTOGRAPHIC MATERIAL HAVING MULTI-LAYERED RED-SENSITIVE, GREEN-SENSITIVE AND BLUE-SENSITIVE EMULSION LAYERS

This application is a continuation of application Ser. No. 605,571, filed Apr. 30, 1984.

BACKGROUND OF THE INVENTION

This invention relates to a light-sensitive silver halide color photographic material having high sensitivity as well as excellent image quality, more particularly to a light-sensitive silver halide color photographic material which is high in sensitivity and can also exhibit excellent sharpness and graininess.

Heretofore, for light-sensitive silver halide color photographic material (hereinafter abbreviated as light-sensitive material), development of a light-sensitive material having high sensitivity and excellent image quality has been desired. Particularly, in recent years, with the increase of photographing under bad conditions with small quantity of light and small formatting of a light-sensitive material, development of a light-sensitive material excellent in sharpness and graininess has been strongly desired. However, it has been difficult to improve image quality along with higher sensitization.

For example, as the technique for higher sensitization, the technique has been known in which a layer constitution of regular sequence having respective layers of red-sensitive, green-sensitive and blue-sensitive light-sensitive silver halide emulsion layers (light-sensitive silver halide emulsion layer is hereinafter referred to merely as "emulsion layer") is provided by coating on a support, a part or whole of the light-sensitive emulsion layers being separated into a high sensitivity silver halide emulsion layer (hereinafter referred to as high sensitivity emulsion layer) and a low sensitivity silver halide emulsion layer (hereinafter referred to as low sensitivity emulsion layer), each containing a diffusion resistant coupler capable of color forming to substantially the same hue, and wherein these layers are laminated adjacent to each other. According to such a constitution, there is involved the problem that the emulsion layer on the side nearer to the support will suffer from absorption of light by other emulsion layers positioned on the side farther from the support during exposure. Moreover, during development, a considerably long time is required for diffusion of a developer. Thus, according to such a layer constitution of regular sequence, due to loss in dosage of exposure and retardation in development, it is difficult to achieve higher sensitization in green-sensitive and red-sensitive emulsion layers positioned as lower layers.

On the other hand, techniques to alter the order of respective emulsion layers laminated are known.

For example, U.S. Pat. No. 3,663,228 discloses a constitution comprising:

(a) the respective low sensitivity emulsion layers of red-sensitive, green-sensitive and blue-sensitive layers provided by coating on a support in the order mentioned from the support side; and (b) the respective high sensitivity emulsion layers of red-sensitive, green-sensitive and blue-sensitive layers provided by coating on the side farther from the support in the order mentioned from the support side, as shown in FIG. 1C annexed to the specification. This technique can afford higher sensitivity as compared with the constitution of regular sequence as described above. However, as can clearly be seen from the fact that each unit of laminates of the aforesaid high sensitivity emulsion layer and low sensitivity emulsion layer are separated by ND (neutral density) filter, higher sensitization is not the gist of interest.

Next, U.S. Pat. No. 3,658,536 discloses a technique to cancel loss of dosage in a green-sensitive emulsion layer having great effect on visual sensitivity by positioning the green-sensitive emulsion layer on the surface side farther from the support, as shown in FIG. 5 annexed to the specification. However, according to such a layer constitution, high sensitization technique of a blue-sensitive emulsion layer is not dealt with at all, and also improvement of sharpness and graininess is not satisfactory.

Otherwise, there have also been known techniques concerning alteration of the layer constitution as disclosed in Japanese Provisional Patent Publications No. 49027/1976 and No. 97424/1978 and U.S. Pat. No. 4,129,446. However, any of these techniques, while higher in sensitivity than the layer constitution of regular sequence as described above, is not only unsatisfactory in sensitivity of green-sensitive and red-sensitive emulsion layers but also unsatisfactory in effects of improvement of image quality such as graininess and sharpness.

In the light of the state of the art as mentioned above, the present inventors have continued to study cancelling the drawbacks or inconveniences of the prior art and consequently already invented and proposed a technique as disclosed in Japanese Provisional Patent Publication No. 177551/1984. This technique provides a light-sensitive material comprising at least one layer of green-sensitive silver halide emulsion layer, at least one layer of red-sensitive silver halide emulsion layer and a plural number of blue-sensitive silver halide emulsion layers with different sensitivities provided on a support, wherein one of the said plural number of blue-sensitive silver halide emulsion layers is provided as the silver halide emulsion layer positioned on the side farthest from the support, said respective at least one layer of green-sensitive silver halide emulsion and at least one layer of red-sensitive silver halide emulsion are provided between the said blue-sensitive silver halide emulsion layer provided on the farthest side and a blue-sensitive silver halide emulsion layer lower in sensitivity than the said blue-sensitive silver halide emulsion layer, further at least one layer of silver halide emulsion layers of said green-sensitive layer and red-sensitive layer sandwiched between the said two blue-sensitive emulsion layers, including the said two blue-sensitive emulsion layers, contain mono-dispersed silver halide grains, and at least one layer of the green-sensitive emulsion layers sandwiched between the said two blue-sensitive emulsion layers contains a colored magenta coupler.

According to the technique of the prior technique by the present inventors, any of blue-sensitive, green-sensitive and red-sensitive emulsion layers can be made higher in sensitivity and at the same time excellent sharpness and graininess can be exhibited.

The present inventors have further continued to study such a technique according to the prior proposal and consequently completed a novel technique capable of exhibiting equal to or more excellent characteristics than said prior technique by way of a technique different from said prior technique to accomplish the present invention.

Accordingly, a first object of this invention is to provide a light-sensitive material in which any of blue-sensitive, green-sensitive and red-sensitive emulsion layers has high sensitivity.

A second object of this invention is to provide a light-sensitive material which is high in sensitivity and can also exhibit excellent sharpness and graininess.

A third object of this invention is to accomplish the above first and second objects by way of a technique different from that according to the prior technique by the present inventors.

A fourth object of this invention is to provide a light-sensitive material which can improve graininess better than the above technique of the prior technique, while maintaining sharpness.

Other objects will be apparent from the following description in this specification.

SUMMARY OF THE INVENTION

This invention which can accomplish the above objects is a light-sensitive material having red-sensitive, green-sensitive and blue-sensitive emulsion layers, each layer consisting of two or more layers with different sensitivities on a support, wherein the layers are constituted so as to satisfy the following requirements (A), (B), (C) and (D):

(A) of the respective emulsion layers having the highest sensitivities among the said red-sensitive, green-sensitive and blue-sensitive emulsion layers, the highest sensitivity blue-sensitive emulsion layer is provided on the side farthest from the support;

(B) at least the said highest sensitivity red-sensitive emulsion layer (hereinafter called as the high sensitivity red-sensitive emulsion layer of this invention) and the highest sensitivity green-sensitive emulsion layer (hereinafter called as the high sensitivity green-sensitive emulsion layer of this invention) are provided between the said highest blue-sensitive emulsion layer (hereinafter called as the high sensitivity blue-sensitive emulsion layer of this invention) and a blue-sensitive emulsion layer with lower sensitivity (hereinafter called as the low sensitivity blue-sensitive emulsion layer of this invention);

(C) none of the respective red-sensitive, green-sensitive and blue-sensitive emulsion layers having the lowest sensitivities exists on the side farther than said low sensitivity blue-sensitive emulsion layer from the support; and (D) contained in at least one layer of said high sensitivity red-sensitive, green-sensitive and blue-sensitive layers, is a diffusion-resistant compound capable of forming a mobile dye through the coupling reaction with the oxidized product of a chromogenic developing agent.

DETAILED DESCRIPTION OF THE INVENTION

Hereinafter, this invention will be explained in detail.

The sensitivity difference between the high sensitivity emulsion layer and the low sensitivity emulsion layer may be 0.2 log E to 1.0 log E (E: dosage of exposure), preferably 0.3 log E to 0.6 log E, with considerations about graininess and gradation. In this invention, it is also possible to provide a medium sensitivity emulsion layer having an intermediate sensitivity between the sensitivity of the high sensitivity emulsion layer and the low sensitivity emulsion layer. When such a layer is provided, the sensitivity difference between said medium sensitivity emulsion layer and the high sensitivity emulsion layer may be 0.1 log E to 0.6 log E. The sensitivity difference between said medium sensitivity emulsion layer and the low sensitivity emulsion layer may be 0.1 log E to 0.6 log E.

Further, the high sensitivity emulsion layer and the low sensitivity emulsion layer, including the medium sensitivity emulsion layer, have substantially the same color sensitiveness, and after the color developing processing, the respective emulsion layers should preferably be capable of forming chromogenic dyes haing substantially the same hue.

According to a preferred embodiment, the layer constitution of the light-sensitive material of this invention comprises, as the light-sensitive emulsion layers, in the order nearer to the support, respective low sensitivity red-sensitive and green-sensitive emulsion layers and low sensitivity blue-sensitivity emulsion layer provided by coating on a support, and on these emulsion layers respective high sensitivity red-sensitive, green-sensitive and blue-sensitive emulsion layers provided by coating.

Between the low sensitivity layer and the high sensitivity layer of the blue-sensitive emulsion layers, at least the respective high sensitivity red-sensitive and green-sensitive emulsion layers of this invention are provided, and it is preferable to have the high sensitivity green-sensitive emulsion layer on the side farther from the support than the high sensitivity red-sensitive emulsion layer of this invention. By such a constitution, the green-sensitive emulsion layer having a great effect on visual sensitivity can reduce the effect of light scattering by the silver halide grains contained in a layer positioned upper to said green-sensitive layer.

Each of the respective high sensitivity green-sensitive, red-sensitive and blue-sensitive emulsion layers of this invention may be provided by coating in two or more separate layers. Such emulsion layers having the same color sensitiveness provided by coating in separate layers are not necessarily positioned adjacent to each other. Also, the respective light-sensitive emulsion layers provided by coating in separate layers may also differ in sensitivity between the emulsion layers having the same color sensitiveness. That is, when at least one layer of the high sensitivity blue-sensitive emulsion layer of this invention and the respective high sensitivity green-sensitive and red-sensitive emulsion layers is provided by coating in two or more separate layers, it can be divided into, for example, a high sensitivity layer and a medium sensitivity layer.

Thus, when separated into two or more layers, the medium sensitivity blue-sensitive emulsion layer may be positioned on the side farther from the support than the high sensitivity blue-sensitive emulsion layer of this invention. However, it is preferred that no other silver halide emulsion layer than the above medium sensitivity emulsion layer should exist on the side farther from the support than the high sensitivity emulsion layer of this invention.

On the side nearer to the support than the low sensitivity blue-sensitive emulsion layer of this invention, it is preferred to provide, for example, the low sensitivity red-sensitive emulsion layer and the low sensitivity green-sensitive emulsion layer. When the above low sensitivity red-sensitive and green-sensitive emulsion layers are to be provided, the green-sensitive emulsion layer should preferably be positioned farther from the support than the red-sensitive emulsion layer. Each of such low sensitivity red-sensitive and green-sensitive emulsion layers may be provided by coating in two or more separate layers, and also in this case, the sensitivities may be made different between the emulsion layers with the same color sensitiveness. That is, when at least one of the low sensitivity red-sensitive and green-sensitive emulsion layers is provided by coating in two or more separate layers, it can be separated into a medium sensitivity layer and a low sensitivity layer. For these separated layers, the emulsion layers with the same color sensitiveness are not required to be adjacent to each other.

In the light-sensitive material of this invention, it is also possible to provide a non-light-sensitive intermediate layer between the respective light-sensitive emulsion layers. In particular, it is preferable to provide a non-light-sensitive intermediate layer, when light-sensitive emulsion layers with different color sensitivenesses exist adjacent to each other. Also, when adjacent light-sensitive emulsion layers are both the high sensitivity emulsion layers of this invention, it is preferred to provide a non-light-sensitive intermediate layer therebetween.

In this invention, a yellow filter layer may also be provided. In such a case, it is preferred to provide it on the support side adjacent to the blue-sensitive high sensitivity and/or low sensitivity emulsion layer of this invention. More preferably, it should be positioned on the support side of the low sensitivity blue-sensitive emulsion layer of this invention.

Specific examples of the layer constitution in the light-sensitive material of this invention are set forth below, which are not limitative of the invention. The sides nearer to the support are mentioned earlier.

(1) Support, respective low sensitivity red-sensitive, green-sensitive and blue-sensitive emulsion layers, respective high sensitivity red-sensitive, green-sensitive and blue-sensitive emulsion layers.

(2) Layer constitution of (1), wherein a medium sensitivity green-sensitive emulsion layer is positioned between the high sensitivity red-sensitive emulsion layer and the high sensitivity green-sensitive emulsion layer.

(3) Layer constitution, which is the same as (1), except that the positions of the respective high sensitivity red-sensitive and green-sensitive emulsion layers are inversed.

(4) Layer constitution of (1), wherein the above low sensitivity green-sensitivity emulsion layer is separated into two layers, which are made to have low sensitivity and medium sensitivity from the side nearer to the support, respectively.

(5) Layer constitution of (1), wherein respective medium sensitivity red-sensitive and green-sensitive emulsion layers are positioned from the side nearer to the support between the low sensitivity blue-sensiive emulsion layer and the high sensitivity red-sensitive emulsion layer.

(6) Layer constitution of (1), wherein respective medium sensitivity red-sensitive, green-sensitive and blue-sensitive emulsion layers are positioned from the side nearer to the support between the low sensitivity blue-sensitive emulsion layer and the high sensitivity red-sensitive emulsion layer.

(7) Layer constitution of (1), wherein the respective high sensitivity red-sensitive, green-sensitive and blue-sensitive emulsion layers are separated into two layers, which are made to have medium sensitivity and high sensitivity emulsion layers from the side nearer to the support, respectively.

(8) Layer constitution of (1), wherein the respective high sensitivity red-sensitive and green-sensitive layers are separated into two layers, which are made to have medium sensitivity and high sensitivity emulsion layers from the side nearer to the support, respectively.

(9) Layer constitution of (1), wherein a medium sensitivity blue-sensitive emulsion layer is positioned between the low sensitivity blue-sensitivity emulsion layer and the high sensitivity red-sensitive emulsion layer.

(10) Layer constitution of (1), wherein the respective low sensitivity red-sensitive and green-sensitive emulsion layers are separated into two layers, which are made to have low sensitivity and medium sensitivity emulsion layers from the side nearer to the support, respectively.

(11) Layer constitution of (1), wherein the respective low sensitivity red-sensitive, green-sensitive and blue-sensitive emulsion layers are separated into two layers, which are made to have low sensitivity and medium sensitivity emulsion layers from the side nearer to the support, respectively.

(12) Layer constitution of (1), wherein the low sensitivity red-sensitive emulsion layer is separted into two layers, which are made to have low sensitivity and medium sensitivity emulsion layers from the side nearer to the support, respectively.

Having set forth above specific examples of the layer constitution of the light-sensitive material of this invention, the constituent layers of the light-sensitive material of this invention may of course include other constituent layers such as non-light-sensitive intermediate layer, protective layer, subbing layer, halation prevention layer, and the like.

The light-sensitive silver halide to be used in the light-sensitive emulsion layer of this invention may have grain sizes which are not limited. For example, for a high sensitivity emulsion layer, in order to make smaller deterioration of sharpness of the emulsion layer positioned on the lower side, it is preferred to avoid presence of smaller particles with great light scattering, and the mean grain size may preferably be 0.4 to 2.5$\mu$. On the other hand, for a medium sensitivity emulsion layer, it may preferably be 0.2 to 1.5$\mu$, while 0.1 to 1.0$\mu$ for a low sensitivity emulsion layer.

The silver halide to be used in the present invention may preferably be silver iodobromide and silver bromide in an aspect of high sensitivity, but it is also possible to use silver chlorobromide and silver chloroiodobromide.

Monodispersed emulsion

The object of this invention can be more effectively achieved by containing a monodispersed silver halide emulsion in an amount of 50% by weight or more as a silver halide quantity in the emulsion layer of this invention, in at least one emulsion layer of the red-sensitive, green-sensitive and blue-sensitive emulsions having at least high sensitivity. It is further preferred that monodispersed silver halide emulsion should be contained in all of these emulsion layers in an amount of 50% by weight or more as a silver halide quantity.

The monodispersed silver halide (grains) herein mentioned refers to one having a value of the standard deviation S of the grain size distribution of the silver halide grains as defined by the following formula divided by an average grain size $\bar{r}$ of 0.20 or less:

$$S = \sqrt{\frac{\Sigma(\bar{r} - r_i)^2 n_i}{\Sigma n_i}}$$

$$S/\bar{r} \leqq 0.20$$

Further, it is particularly preferred that $S/\bar{r}$ should be not greater than 0.15.

The average grain size $\bar{r}$ herein mentioned means an average value of diameters of spheres when silver halide grains are spherically shaped or diameters of spherical images calculated to have the same area as the projected images of the shapes other than spheres such as cubic bodies whey they are in the form of such shapes, and $\bar{r}$ is defined by the following formula when individual grains have sizes of ri in number of ni:

$$\bar{r} = \frac{\Sigma ni\, ri}{\Sigma ni}$$

Each of the silver halide grains to be used in the present invention is most preferably a core-shell type silver halide grain, and it is preferred that each silver halide grain should be constituted so that the content of silver iodide in the silver halide of the surface layer (the outermost shell in the case of a double-core shell type having two or more shells) may not substantially be changed. The wording "not substantially changed" herein mentioned means that the silver iodide content in the surface layer is not substantially changed even when the average grain size may be changed. More specifically, the difference in silver iodide content between grains in the surface layer should preferably not exceed 0.5 mole %. By this, the above objects of this invention can be achieved more effectively, and developing activity can be made regular simultaneously with stabilization of chemical aging. When a core-shell type silver halide grain is used in the present invention, its surface layer should preferably be constituted of not more than 50% of the weight of the whole grain, particularly 20% or less. The silver halide in the surface layer should preferably be a silver iodobromide with a silver iodide content of 3 mole % or less, particularly preferably silver bromide containing substantially no silver iodide. And, the silver iodide content in the core (the portion other than the surface layer, hereinafter the same) in the core-shell type should preferably be a silver halide containing 0 to 15 mole % of silver iodide. The mono-dispersed silver halide of this invention may preferably have a crystal habit of hexahedral, octahedral or tetradecahedral.

The diffusion resistant compound to be used in this invention, which can undergo a coupling reaction with the oxidized product of a chromogenic developing agent to form a mobile dye (hereinafter called as the mobile coupler of this invention) is contained in at least one layer of the respective high sensitivity red-sensitive, green-sensitive and blue-sensitive emulsion layers, preferably in all of said high sensitivity emulsion layers. The amount of the mobile coupler of this invention contained, which is not particularly limited, may be such that 5 to 100 mole % of the total couplers contained in the respective high sensitivity emulsion layers is the mobile coupler of this invention, with the balance being conventional couplers which can form substantially non-mobile dyes. When the layers with the same color sensitiveness are provided as emulsion layers of 3 layers or more, for example, high sensitivity, medium sensitivity and low sensitivity emulsion layers, it is preferred to use the mobile coupler of this invention also in the medium sensitivity emulsion layer. But, in this case, it should be employed to such an extent that the unfocused dye image obtained will not have a great effect on sharpness.

In the light-sensitive material of this invention, when the emulsion layers with the same color sensitiveness are constituted of three silver halide emulsion layers, for example, when the green-sensitive emulsion layer is provided by the three separated layers of high sensitivity, medium sensitivity and low sensitivity, and when the mobile coupler of this invention is incorporated only in the high sensitivity emulsion layer, the chromogenic density in the high sensitivity emulsion layer should desirably be made 0.1 to 1.0. Also, when the mobile coupler of this invention is to be contained in the high sensitivity and medium sensitivity emulsion layers in the case of such a three-layer constitution, the total of the chromogenic densities in both emulsion layers should desirably be made 0.1 to 1.0. In these cases, the total chromogenic density of the three layers is 0.2 to 1.5.

On the other hand, when the light-sensitive material of this invention comprises two silver halide emulsion layers having the same color sensitiveness, the chromogenic density in the high sensitivity emulsion layer of this invention should desirably be 0.1 to 1.5.

The mobile coupler of this invention should preferably be used in the high sensitivity green-sensitive emulsion layer giving the greatest effect to visual sensitivity, particularly preferably in all of the respective high sensitivity red-sensitive, green-sensitive and blue-sensitive emulsion layers of this invention.

The mobile couplers of this invention can be classified broadly into two types of compounds. One is a diffusion resistant coupler which forms a slightly mobile dye, and the other is a diffusion resistant coupler which forms a completely diffusible dye.

The "slightly mobile" herein mentioned means that the dye is mobile only within the layer in which the mobile coupler capable of forming a mobile dye of this invention is contained. On the other hand, "completely diffusible" means that the dye formed can be migrated and diffused from the layer containing the above diffusion resistant coupler to adjacent layers.

The effect by the former coupler is improvement of graininess by slight migration of the dye formed by the reaction with the oxidized product of a chromogenic developing agent thereby to spread thinly the dye cloud.

When the dye formed from the mobile coupler of this invention is completely diffusible, the dye cloud is further spread increasingly until it reaches the adjacent layers and finally fixed by a mordant, when such a mordant as described below is used, whereby graininess may be similarly improved. The above mordant is described hereinbelow.

The mobile coupler of this invention has a ballast group for immobilizing the coupler at the coupling position and a control group for controlling the mobility of the dye formed at the non-coupling position. When the above couplers undergo coupling with the oxidized product of a chromogenic developing agent, the ballast group will be eliminated, whereby the dye formed becomes mobile. The mobility of the mobile dye can be controlled by the control group. For example, in one extreme case, it will become a slightly mobile dye, while in the other extreme case, it will become a completely diffusible dye. Such a control group depends on the coupler mother nucleus, other substituents introduced into the coupler and the chromogenic developing agent employed, and the same substituent in a certain kind of coupler may make the dye formed completely diffusible, or in another coupler may make the dye formed slightly mobile.

The mobile coupler of this invention as described above may be represented by the following formula [I]:

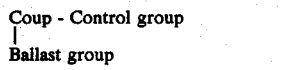

[I]

In the above formula, Coup is a coupler mother nucleus capable of forming a dye, Ballast group is a group which is bonded to the coupling position of said coupler mother nucleus and can be eliminated from Coup during the coupling reaction between said coupler and the oxidized product of a color developing agent, and the above Ballast group has a size and a shape of molecule enough to make the coupler non-diffusive.

The Control group is a group bonded to Coup at the non-coupling position for controlling the color forming dye formed through the coupling reaction between the coupler and the oxidized product of a chromogenic developing agent so that it may be slightly mobile or completely diffusible.

The above Coup, which represents a coupler mother nucleus, may be any of the coupler mother nuclei which is known or used in this field of the art for forming a color forming dye by the coupling reaction with the oxidized product of a chromogenic developing agent.

For example, as the yellow dye forming couplers, there may be employed acylacetanilide type acetoacetanilides and benzoylacetanilides; as magenta dye forming couplers, it is possible to use pyrazolones, pyrazolotriazoles, pyrazolobenzimidazoles and indazolones; and further as cyan dye forming couplers, there are phenols and napthols. Any of these couplers can form the coupler portion; namely Coup.

The above ballast group has a size and a shape of molecule enough to make the coupler non-diffusive. Useful ballast groups of this kind are inclusive of groups having an alkyl moiety or an aryl moiety with 8 or more carbon atoms, preferably 8 to 32 carbon atoms. And, the above ballast group may have a cross linking group at the coupling position of the coupler mother nucleus. Typical cross linking groups of this kind may include, for example, —O—, —S—, —N=N—,

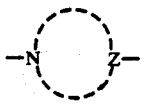

(wherein Z is a group of atoms necessary for forming a 5- to 7-membered heterocyclic ring). Preferably, the ballast group may be an alkoxy, aryloxy, alkylthio, arylthio and nitrogen-containing heterocyclic ring, each having 8 to 32 carbon atoms.

The above control group in this invention is a group having a size and a shape of molecule suitable for imparting slight mobility to the color forming dye formed in one extreme, while it is an alkali solubilizing group which makes the dye completely diffusible in the other extreme. As the group suitable for imparting slight mobility to the above dye as described above, it is preferred to use an alkyl group having 1 to 20 carbon atoms and an aryl group having 6 to 20 atoms. These groups may also be substituted with a group for changing the spectral characteristics or mobility of the color forming dye. These control groups may also have cross linking groups for bonding said control group to the coupler mother nucleus. Such cross linking groups may include, for example, —O—, —S—, —CO—, —COO—, —NR—, —CONR—, —NRCO—, —$SO_2$NR—, —NR-$SO_2$—, —NRCONR— (wherein R is a hydrogen atom, an alkyl group or an aryl group) and the like.

On the other hand, the alkali solubilizing group which will make the dye completely diffusible is a group ionizable under developing processing conditions, including, for example, groups containing at least one of hydroxy group, carboxylic group, sulfonic acid group, aminosulfonyl group and salts thereof. These groups may also have cross linking groups for bonding said groups to the coupler mother nucleus. Typical examples of such cross linking groups may include, for example, —O—, —S—, —CO—, —COO—, —NR—, —CONR—, —NRCO—, —$SO_2$NR—, —NR$SO_2$—, —NRCONR— (wherein R is a hydrogen atom, an alkyl group or an aryl group) and the like.

Of the mobile couplers of this invention, the couplers preferable as the yellow coupler may be represented by the following formula [II]:

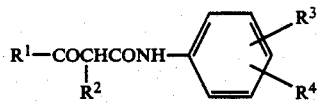

[II]

wherein $R^1$ is an aryl group (e.g. a phenyl group) or an alkyl group (e.g. a tertiary alkyl group such as a t-butyl group); $R^2$ is the ballast group as defined above; $R^3$ is the control group as defined above; and $R^4$ is a hydrogen atom, a halogen atom, an alkyl group, an alkoxy group or the control group.

Next, preferable cyan couplers may be represented by the following formulae [III] and [IV]:

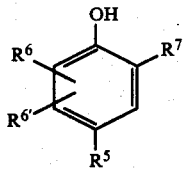

[III]

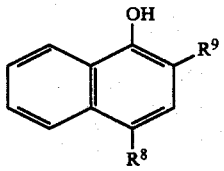

[IV]

wherein $R^5$ represents the same meaning as $R^2$ defined in the formula [II]; at least one of $R^6$, $R^{6'}$ and $R^7$ is the control group as defined above, other two groups representing either identical or different hydrogen atoms, halogen atoms, alkyl groups, alkoxy groups, alkylamino groups or acylamide groups; $R^8$ is the same as the above $R^5$; and $R^9$ represents the control group.

Further, preferable magenta couplers can be represented by the following formulae [V] and [VI]:

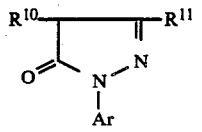

[V]

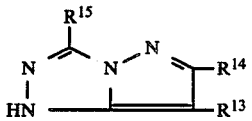

[VI]

wherein $R^{10}$ is the same as $R^5$ defined in the formula [III]; $R^{11}$ represents the control group; Ar is a phenyl group which may have at least one substituent selected from halogen atoms, alkyl groups, alkoxy groups or amino groups, said phenyl group optionally having the aforesaid control group; $R^{13}$ represents the same group as the above $R^{10}$; one of $R^{14}$ and $R^{15}$ represents the control group and the other represents a hydrogen atom, an alkyl group, an alkoxy group, an aryl group, an amino group or an acylamide group.

In the above compounds, unless otherwise specifically noted, the alkyl group, the alkoxy group and the alkylamino group each contains 1 to 8 carbon atoms, the aryl group contains 6 to 10 carbon atoms, and the amino group is inclusive of primary, secondary and tertiary amino groups. These groups and the control groups may also include those substituted with the groups such as halogen atom, hydroxy, carboxy, amino, amide, carbamoyl, sulfamoyl, sulfonamide, alkyl, alkoxy and aryl.

In the following, typical specific examples of the mobile couplers of this invention are enumerated, but this invention is not limited thereto.

(Exemplary compounds)

(C-1)

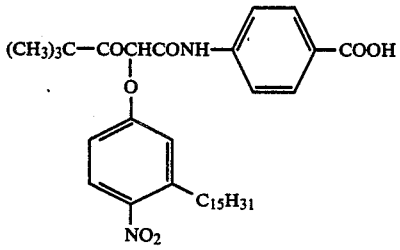

(C-2)

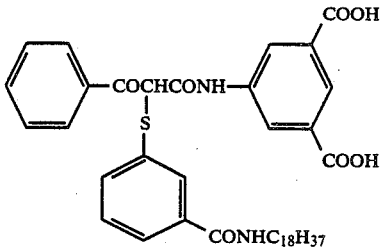

(C-3)

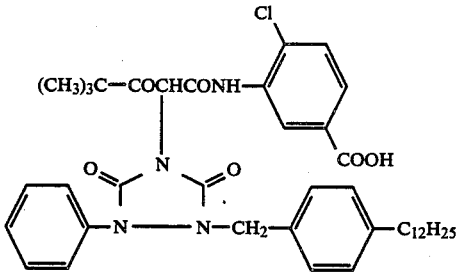

(C-4)

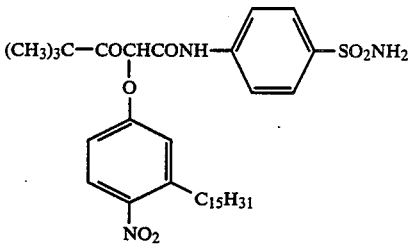

(C-5)

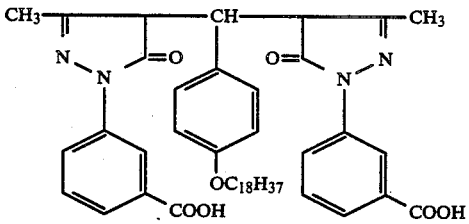

(C-6)

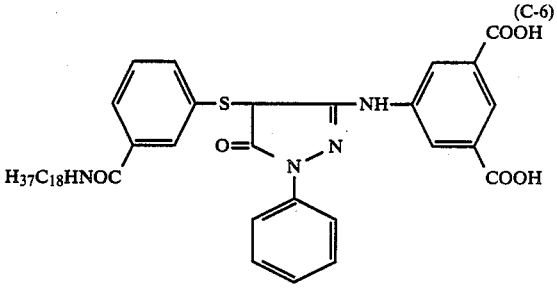

(C-7)

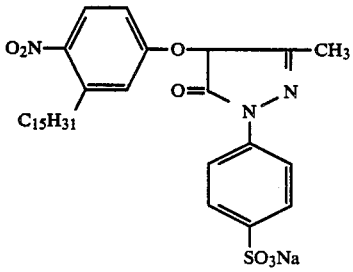

(C-8)

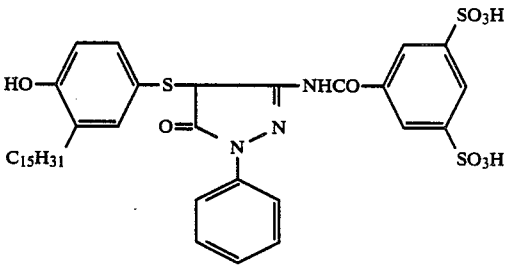

-continued
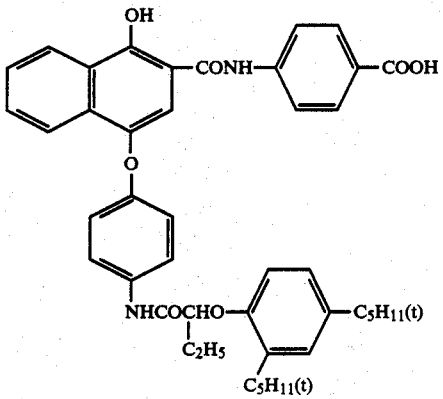
(C-9)
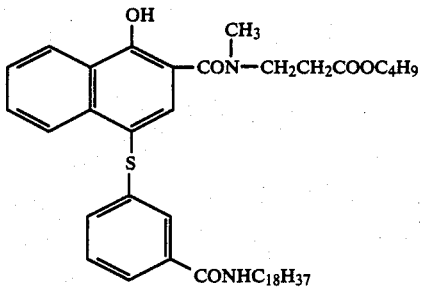
(C-10)
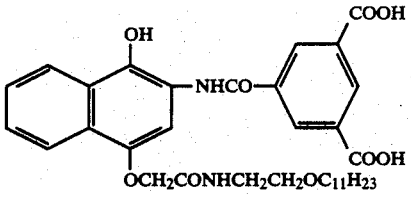
(C-11)
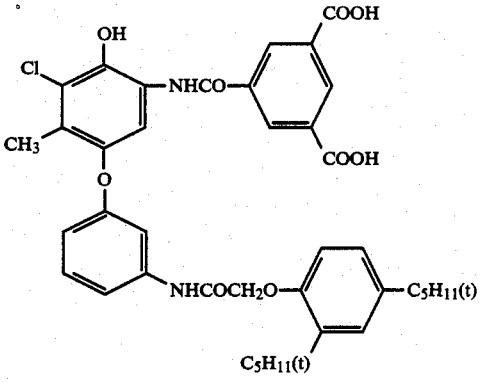
(C-12)
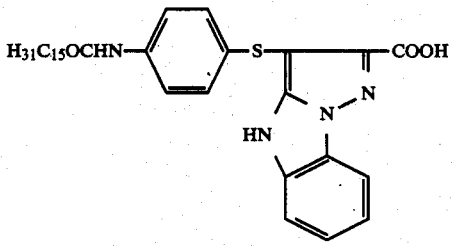
(C-13)
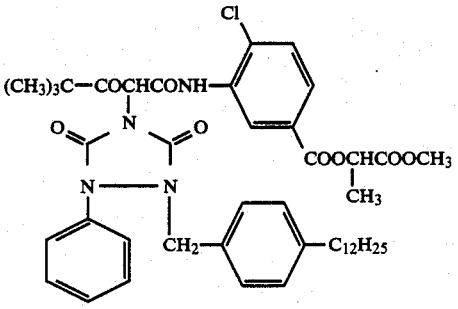
(C-14)
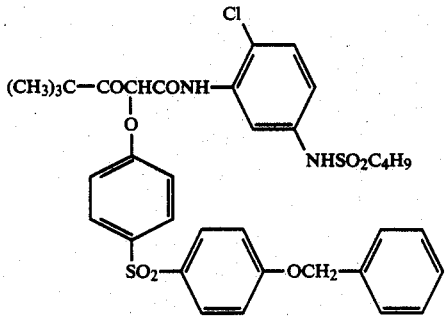
(C-15)
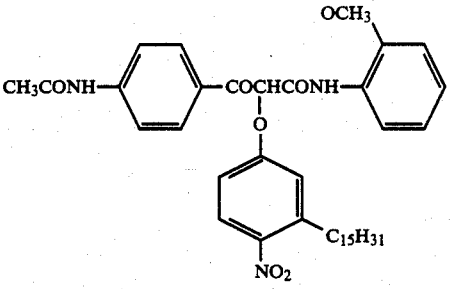
(C-16)

-continued
(C-17)
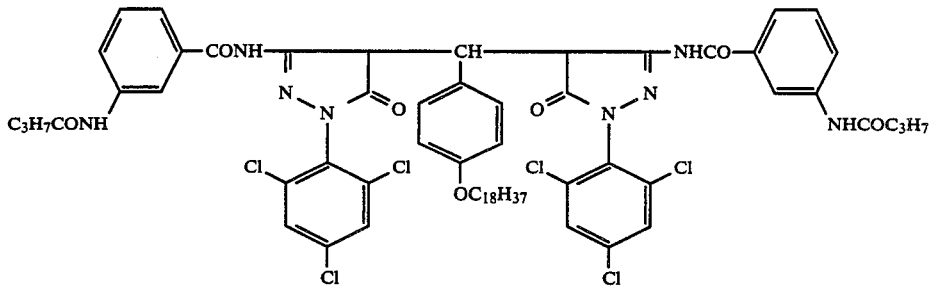
(C-18)
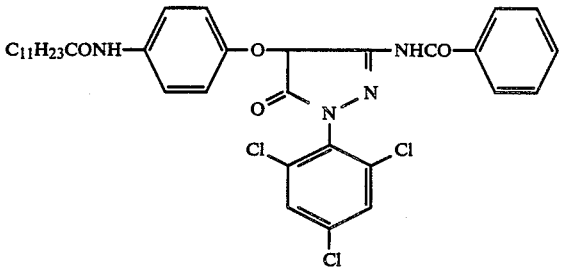
(C-19)
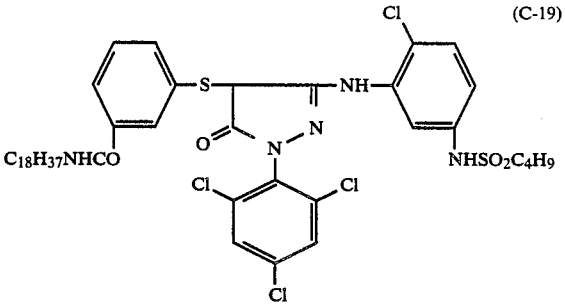
(C-20)
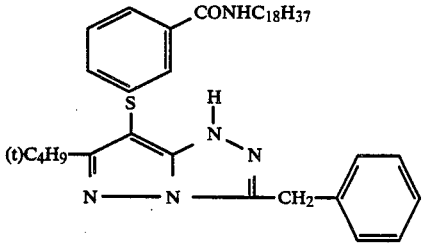
(C-21)
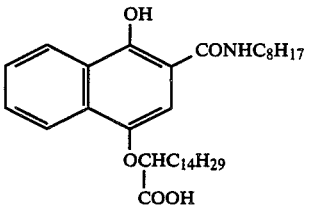
(C-22)
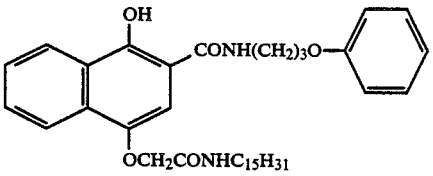
(C-23)
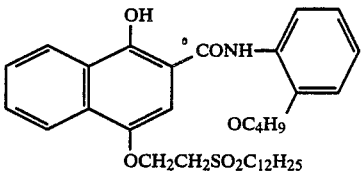
(C-24)
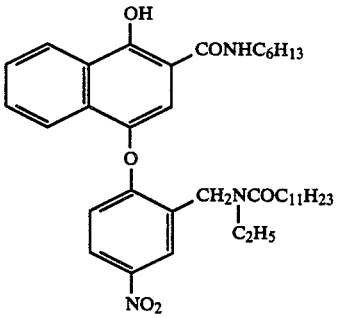
(C-25)
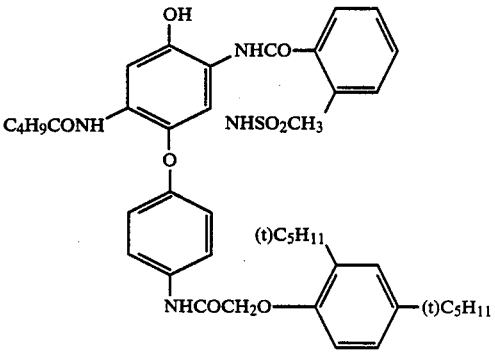

-continued (C-26)

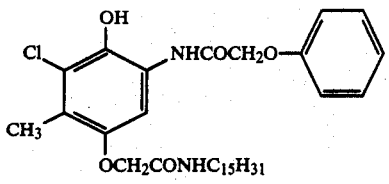

(C-27)

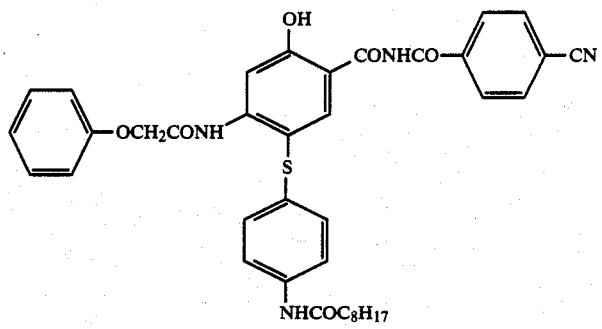

(C-28)

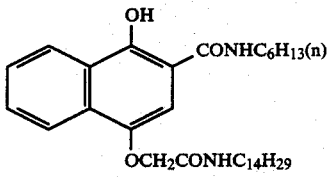

(C-29)

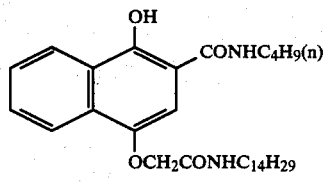

(C-30)

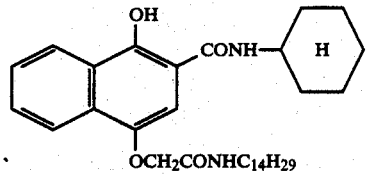

(C-31)

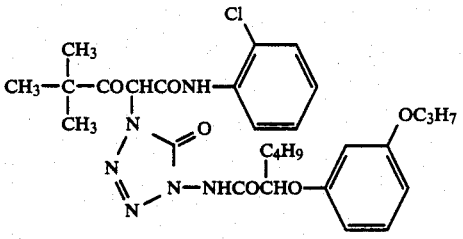

(C-32)

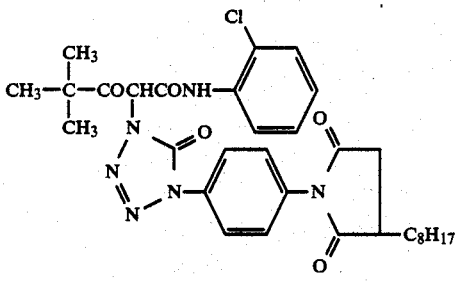

(C-33)

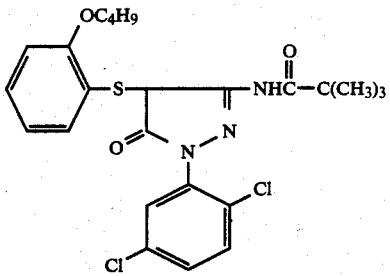

(C-34)

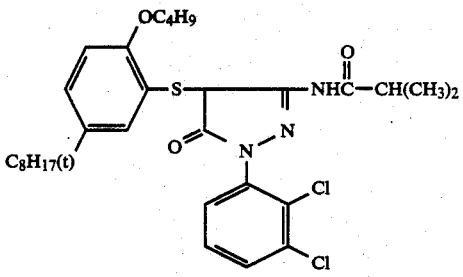

These compounds can be used either singly or in combination.

In the emulsion layer in which the mobile coupler of this invention is to be contained, there may be contained a compound capable of releasing a development inhibiting substance (hereinafter called as DIR compound). By doing so, spreading of the dye cloud formed from the mobile coupler of this invention can be adequately controlled. This is preferable in respect to improvement of sharpness.

Typical examples of such DIR compounds may include the so-called DIR couplers in which a group capable of forming a compound having a developing inhibiting action on elimination from the active site is introduced into the active site, as disclosed in U.K. Pat. No. 935,454, U.S. Pat. Nos. 3,227,554, 4,095,984 and 4,149,886.

The above DIR coupler has the property on coupling reaction with the oxidized product of a chomogenic developing agent such that the coupler mother nucleus forms a dye, while releasing a development inhibiting agent. In the present invention, there also may be included the compounds which can release a developing inhibiting agent but do not form a dye on coupling reaction with the oxidized product of a chromogenic developing agent, as disclosed in U.S. Pat. Nos.

3,652,345, 3,928,041, 3,958,993, 3,961,959 and 4,052,213, Japanese Provisional Patent Publications Nos. 110529/1978, 13333/1979 and 161237/1980. These DIR compounds may be used either singly or in combination.

In this invention, when the mobile coupler of this invention is capable of forming a completely diffusible dye, it is preferred to use a mordant as a pair with this coupler. This mordant may be any mordant which immobilizes the dye formed as the result of coupling reaction. Preferable mordants are those of basic polymers as disclosed in U.S. Pat. No. 3,958,995, Japanese Provisional Patent Publications Nos. 74430/1979 and 22766/1980, or otherwise polymers of aminoguanidine derivatives of vinyl methyl ketone as disclosed in U.S. Pat. No. 2,882,156 and the basic polymers as disclosed in U.S. Pat. Nos. 3,625,394, 2,709,590 and 3,393,033. Other useful mordants are disclosed in U.S. Pat. No. 3,559,095 and Research Disclosure, pp. 30–32, December, 1976. These mordants may be added into silver halide emulsion layers or alternatively added into an intermediate layer to form a mordant layer.

While it is possible to provide an inactive gelatin layer or another silver halide emulsion layer between the emulsion layer forming the completely diffusible dye of this invention and a mordant layer, the dye image obtained will be deteriorated in sharpness as the distance is greater. Accordingly, in order to minimize such a deterioration in sharpness, a mordant can be incorporated in the emulsion layer containing the mobile coupler of this invention. The amount of the above mordant employed may be 0.1 to 5 $g/m^2$, preferably 0.3 to 1.5 $g/m^2$.

A colored coupler may also be available as the masking coupler in the light-sensitive material of this invention. As the colored magenta coupler as this masking coupler, there may be generally employed a compound substituted at the active site of colorless magenta coupler with an arylazo group as disclosed in, for example, U.S. Pat. Nos. 2,801,171, 2,983,608, 3,005,712 and 3,684,514; U.K. Pat. No. 937,621; and Japanese Provisional Patent Publications Nos. 123625/1974 and 131448/1974.

Further, it is also possible to use a colored magenta coupler of the type of which dye is flown out into a processing bath through the reaction with the oxidized product of a chromogenic developing agent as disclosed in U.S. Pat. No. 3,419,391.

As the colored cyan coupler as the masking coupler, there may be employed a compound substituted at the active site of colorless cyan coupler with an arylazo group as disclosed in, for example, U.S. Pat. Nos. 2,521,908 and 3,034,892; U.K. Pat. No. 1,255,111; and Japanese Provisional Patent Publication No. 22028/1973.

Further, it is also possible to use a colored cyan coupler of the type of which dye is flown out into a processing bath through the reaction with the oxidized product of a chromogenic developing agent as disclosed in U.S. Pat. No. 3,476,563; and Japanese Provisional Patent Publications Nos. 10135/1975 and 123341/1975.

Also, photographic characteristics may be improved with a coupler capable of forming a colorless dye, called the competing coupler, which may also be contained in the light-sensitive material.

The silver halide emulsion to be used in the present invention can be prepared in various ways. The above silver halide photographic emulsion layers may be sensitized with the use of known chemical sensitizers. As chemical sensitizers, there may be employed noble metal sensitizers, sulfur sensitizers, selenium sensitizers and reducing sensitizers, either singly or in combination. Further, the silver halide photographic emulsion can also be spectrally sensitized with the use of known dyes, if desired.

In the light-sensitive silver halide emulsion layers or hydrophilic colloidal layers adjacent thereto of this invention, it may sometimes be preferable for sufficiently exhibiting the effect of this invention to use, in combination, reducing agents or antioxidants, such as sulfites (sodium sulfite, potassium sulfite, etc.), bisulfites (sodium bisulfite, potassium bisulfite, etc.), hydroxylamines (hydroxylamine, N-methylhydroxylamine, N-phenylhydroxylamine, etc.), sulfinic acids (sodium phenylsulfinate, etc.), hydrazines (N,N'-dimethylhydrazine, etc.), reductones (ascorbic acid, etc.), aromatic hydroxarbons having one or more hydroxyl groups (p-aminophenol, gallic acid, catechol, pyrogalol, resorcin, 2,3-dihydroxynaphthalene, etc.).

Further, for further enhancement of the light fastness of the magenta color image formed from the magenta coupler used in this invention, p-alkoxyphenols, phenolic compounds may be added into said emulsion layers or layers adjacent thereto.

The emulsion layers and other layers of this invention are formed by coating according to the known methods on an appropriate substrate such as laminate paper, cellulose acetate, polystyrene and others.

During the manufacturing step, storage or processing of the light-sensitive material, for prevention of lowering in sensitivity and of generating fog, it is possible to add various compounds into the above silver halide emulsion, including heterocyclic compounds such as 1-phenyl-5-mercaptotetrazole, 3-methylbenzothiazole, 4-hydroxy-6-methyl-1,3,3a,7-tetrazaindene, etc. mercapto compounds, metal salts and others.

Film hardening processing of said emulsion may also be conducted in a conventional manner.

To the above silver halide emulsion, surfactants may be added singly or as a mixture. As the surfactant, there may be employed, for example, coating aids, emulsifiers, improving agents for penetrability of processing liquors, defoaming agents, antistatic agents, anti-adhesion agents, various kinds of active agents for improving photographic or controlling physical properties etc.

Also, in the light-sensitive material of this invention, for prevention of unnecessary fogging or contamination of the aromatic primary amine developing agent due to air oxidation or for prevention of color mixing by diffusion of the developing agent to adjacent layers during development, it is useful to employ an alkyl-substituted hydroquinone compound in the silver halide emulsion layers or the intermediate layers, as disclosed in U.S. Pat. Nos. 2,728,659, 2,732,300 and 3,700,453; Japanese Provisional Patent Publication No. 15438/1975; and Japanese Provisional Patent Publication No. 95948/1980.

For incorporation of a compound optionally contained in the respective high sensitivity emulsion layers (hereinafter called as combinable compound) such as DIR compounds or mordants, such compounds can be contained in various forms in a coating solution for the constituent layers in which they are to be contained. In this case, various techniques conventionally employed for couplers may be applicable.

For example, as disclosed in U.S. Pat. No. 2,322,027, such compounds can be added as solutions dissolved in a high boiling point solvent, or alternatively, as disclosed in U.S. Pat. No. 2,801,170, a coupler and a high boiling point solvent may be dispersed in fine particles before mixing. Also, in the method by the use of these dispersions, employment of a low boiling point solvent is also a preferable method. According to this method, the combinable compound may be dispersed by mixing with a coupler or dispersed separately from the coupler. When a low boiling point solvent is employed, the low boiling point solvent may be removed from the dispersion according to the procedure as described in U.S. Pat. No. 2,801,171 or Japanese Patent Publication No. 8099/1974.

Among the solvents applicable, as the high boiling point solvent, those preferred are dibutylphthalate, dioctylphthalate, diisodecylphthalate, triphenylphosphate, tricresylphosphate, diethyllaurylamide, dibutyllaurylamide, benzylphthalate, monophenyl-p-t-butylphenylphosphate, phenoxyethanol, diethyleneglycol monophenyl ether, dimethoxyethylphthalate and hexamethylphosphoramide, and, further, high boiling point organic solvents immiscible with water as disclosed in U.S. Pat. No. 3,779,765, Japanese Provisional Patent Publication No. 90523/1974 and Japanese Patent Publication No. 29060/1973. On the other hand, examples of the low boiling point solvents are methyl isobutyl ketone, β-ethoxyethyl acetate, methoxytriglycol acetate, acetone, methyl acetone, methanol, ethanol, acetonitrile, dioxane, dimethylformamide, dimethyl sulfoxide, ethyl acetate, butyl acetate, isopropyl acetate, butanol, chloroform, cyclohexane, cyclohexanol, fluorinated alcohols, etc. These low boiling point solvents can be used in place of the high boiling point solvents and also as a mixture with the high boiling point solvents. Further, each of these respective solvents may be used singly or as a combination of two or more solvents.

As another method, in the case of a coupler and a combinable compound having water-soluble groups, these can be used in Fischer type, namely by dissolving in an alkali solution. It is also possible to add one of the coupler and the combinable compound according to the dispersion method and the other according to the Fischer type method in the same layer.

The chromogenic developing agent to be used for processing of the light-sensitive material of this invention is an alkaline aqueous solution of pH 8 or higher, preferably pH 9–12, containing a developing agent. The aromatic primary amine as the developing agent means a compound having a primary amino group on the aromatic ring and being capable of developing the silver halide subjected to exposure or a precursor for forming such a compound.

The above developing agents may include p-phenylenediamine type compounds, and typical examples are set forth below:

4-amino-N,N-diethylaniline, 3-methyl-4-amino-N,N-diethylaninine, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-β-methoxyethylaniline, 3-acetamido-4-amino-N,N-diethylaniline, 4-amino-N,N-dimethylaniline, N-ethyl-N-β-[β-(β-methoxyethoxy)-ethoxy]ethyl-3-methyl-4-aminoaniline, N-ethyl-N-β-(β-methoxyethoxy)ethyl-3-methyl-4-aminoaniline, and salts of these such as sulfates, hydrochlorides, sulfites, p-toluenesulfonates, etc.

Further, it is also possible to use the compounds as disclosed in Japanese Provisional Patent Publications Nos. 64932/1973, 131526/1975 and 95849/1976 and Journal of American Chemical Society vol. 73, pp. 3100–3125 (1951) by Bent et al. Various kinds of additives may also be added in these chromogenic developing solutions, such as alkali agents, pH controllers or buffering agents, development accelerators, antifoggants and preservatives.

The light-sensitive material of this invention can be subjected to imagewise exposure, chromogenic developing processing and thereafter bleaching processing in a conventional manner. This processing may be either simultaneous with or separate from fixing. This processing solution may be admixed with a fixing agent, if desired, to give a bleach-fixing bath. As the bleaching agent, various compounds can be used, and various additives, including bleaching accelerators, can also be added.

This invention is further illustrated by referring to the following Examples, by which this invention is not limited at all.

First, the methods for preparation of the emulsions used in Examples are shown below.

Preparation of polydispersed emulsion

An aqueous silver nitrate solution and an aqueous alkali halide solution were permitted to fall naturally into a reactor maintained at 60° C. in which the aqueous gelatin solution and an excess of a halide are previously charged. Then, an aqueous solution of Demol N (produced by Kao-Atlas Co., Ltd.) and an aqueous magnesium sulfate solution were added to effect precipitation and desalting, followed by addition of gelatin, to obtain an emulsion of pAg 7.8 and pH 6.0. Further, chemical ripening was conducted with the use of sodium thiosulfate, chloroauric acid and ammonium rhodanate, 4-hydroxy-6-methyl-1,3,3a,7-tetrazaindene and 6-nitrobenzimidazole were added, followed further by addition of gelatin, to obtain a polydispersed silver iodobromide emulsion.

Average grain sizes and grain size distributions of this preparation were varied by varying the time for addition of the aqueous silver nitrate solution and the aqueous alkali halide solution.

Preparation of monodispersed emulsion

Into a reactor in which seed grains of a silver halide and an aqueous gelatin solution were previously charged, while controlling pAg and pH in the reactor, an aqueous ammoniacal silver nitrate solution and an aqueous solution of potassium iodide and potassium bromide were added in proportion to the increase of the surface area during grain growth. Then, an aqueous solution of Demol N (produced by Kao-Atlas Co., Ltd) and an aqueous magnesium sulfate solution were added to effect precipitation and desalting, followed by addition of gelatin, to obtain an emulsion of pAg 7.8 and pH 6.0. Further, chemical ripening was conducted with the use of sodium thiosulfate, chloroauric acid and ammonium rhodanate, 4-hydroxy-6-methyl-1,3,3a,7-tetrazaindene and 6-nitrobenzimidazole were added, followed further by addition of gelatin to obtain a monodispersed silver iodobromide emulsion. Here, by varying the amounts of ammoniacal silver nitrate and potassium halide, grain sizes were varied.

The core-shell type emulsion was prepared according to the method as described in the above-mentioned Japanese Provisional Patent Publication No. 48521/1979.

EXAMPLE 1

On a transparent support comprising a cellulose triacetate film subjected to subbing treatment and having a halation prevention layer (containing 0.40 g of black colloidal silver and 3.0 g of gelatin), the respective layers shown below were provided successively by coating to prepare Sample 1. In all of the following Examples, the amounts added into the light-sensitive material are indicated as amounts per 1 $m^2$, and the silver halide emulsion and colloidal silver are indicated as calculated on Ag.

Sample 1 Comparative example

Layer 1 A low sensitivity red-sensitive emulsion layer (hereinafter called as RL) containing 1.5 g of low sensitivity red-sensitive silver iodobromide emulsions each color sensitized to red-sensitive, 2.2 g of gelatin and 0.8 g of tricresyl phosphate (TCP) having 1.0 g of 1-hydroxy-4-(β-methoxyethylaminocarbonylmethoxy)-N-[δ-(2,4-di-t-amylphenoxy)butyl]-2-naphthoamide [hereinafter called as Cyan coupler], 0.075 g of 1-hydroxy-4-[4-(1-hydroxy-δ-acetamido-3,6-disulfo-2-naphthylazo)phenoxy]-N-[δ-(2,4-di-t-amylphenoxy)butyl-2-naphthoamide-disodium (hereinafer called as Colored cyan coupler), 0.01 g of 1-hydroxy-2-[δ-(2,4-di-t-amylphenoxy)-n-butyl]naphthoamide, and 0.07 g of 2-bromo-4-(2,2,3,3,4,4,5,5,6,6,7,7,8,8,9,9-hexadecafluorononanoylamino)-7-nitro-2-(1-phenyl-5-tetrazolylthio)-1-indanone [hereinafter called as DIR compound] dissolved therein.

Layer 2 An intermediate layer (hereinafter called as IL) containing 0.04 g of n-dibutylphthalate (hereinafter called as DBP) having 0.07 g of 2,5-di-t-octylhydroquinone (hereinafter called as Contamination preventive) dissolved therein and 0.8 g of gelatin.

Layer 3 A low sensitivity green-sensitive emulsion layer (hereinafter called as GL) containing 1.40 g of low sensitivity green-sensitive emulsions each color sensitized to green-sensitive, 2.2 g of gelatin and 0.95 g of TCP having 0.8 g of 1-(2,4,6-trichlorophenyl)-3-[3-(2,4-di-t-amylphenoxyacetamido)benzamido]-5-pyrazolone (hereinafter called as Magenta coupler), 0.15 g of 1-(2,4,6-trichlorophenyl)-4-(1-naphthylazo)-3-(2-chloro-5-octadecenylsuccinimidoanilino)-5-pyrazolone (hereinafter called as Colored magenta coupler) and 0.012 g of DIR compound dissolved therein.

Layer 4 the same as IL.

Layer 5 A high sensitivity red-sensitive emulsion layer (hereinafter called as RH) containing 1.5 g of a high sensitivity red-sensitive silver iodobromide emulsion, 1.2 g of gelatin and 0.30 g of TCP having 0.26 g of the Cyan coupler and 0.03 g of the Colored cyan coupler dissolved therein.

Layer 6 the same as IL

Layer 7 A high sensitivity green-sensitive emulsion layer (hereinafter called as GH) containing 1.6 g of a high sensitivity green-sensitive emulsion color sensitized to green-sensitive, 1.9 g of gelatin and 0.25 g of TCP having 0.20 g of the Magenta coupler and 0.049 g of the Colored magenta coupler dissolved therein.

Layer 8 A yellow filter layer (hereinafter called as YC) containing 0.15 g of yellow colloidal silver, 0.11 g of DBP having dissolved 0.2 g of the Contamination preventive dissolved therein and 1.5 g of gelatin.

Layer 9 A low sensitivity blue-sensitive emulsion layer (hereinafter called as BL) containing 0.5 g of low sensitivity blue-sensitive silver iodobromide emulsions each sensitized to blue-sensitive, 1.9 g of gelatin and 0.6 g of TCP having 1.5 g of α-pivaloyl-α-(1-benzyl-2-phenyl-3,5-dioxoimidazolidin-4-yl)-2'-chloro-5'-[α-dodecyloxycarbonyl)ethoxycarbonyl]acetanilide [hereinafter called as Yellow coupler] dissolved therein.

Layer 10 A high sensitivity blue-sensitive emulsion layer (hereinafter called as BH) containing 0.8 g of a high sensitivity emulsion sensitized to blue-sensitive, 1.5 g of gelatin and 0.65 g of TCP having 1.30 g of the Yellow coupler dissolved therein.

Layer 11 Protective layer (hereinafter called as PR) having 2.3 g of gelatin.

Similarly as in the above Sample 1, Samples 2–9 were prepared as follows.

Sample 2 Comparative example

Layer 1 the same as RL
Layer 2 the same as IL
Layer 3 the same as GL
Layer 4 the same as IL
Layer 5 the same as BL
Layer 6 the same as IL
Layer 7 the same as RH
Layer 8 the same as IL
Layer 9 the same as GH
Layer 10 the same as IL
Layer 11 the same as BH
Layer 12 the same as PR

Sample 3 This invention

Prepared similarly as Sample 2, except for replacing 30 mole % of the Magenta coupler in the emulsion layer in GH of Sample 2 with the exemplary compound (C—18) of the mobile coupler of this invention. It was added in the following manner.

A mixture of 5.6 g of the mobile coupler (C—18), 9.6 g of the Magenta coupler and 3.8 g of the Colored magenta coupler dissolved in 30 ml of ethyl acetate and 18.8 g of TCP was mixed with 20 ml of an aqueous 10% solution of Alkanol B (alkylnaphthalenesulfonate, produced by Du Pont de Nemours & Co.) and 200 ml of an aqueous 5% gelatin solution, followed by emulsification in a colloid mill. Then, the coupler dispersion was mixed with a high sensitivity green-sensitive emulsion, and provided by coating at the same level of weight per unit area as in Sample 2.

Sample 4 This invention

In preparation of Sample 3, only the content of the mobile coupler of this invention was changed to 100 mole %.

Sample 5 This invention

Prepared similarly as in Sample 2, except for replacing 50 mole % of the Magenta coupler in the GH emulsion layer in Sample 2 with the exemplary compound (C—18) of the mobile coupler of this invention and also replacing 50 mole % of the Cyan coupler in RH emulsion layer with the mobile coupler (C—27) of this invention. The method for addition of respective couplers was the same as in Sample 3.

Sample 6 This invention

Prepared similarly as in Sample 2, except for providing a medium sensitivity blue-sensitive emulsion layer (hereinafter called as BM) shown below between the BH emulsion layer (Layer 11) and the intermediate layer (Layer 10) in Sample 2 and replacing 50 mole % of the Yellow coupler in the BH emulsion layer with the mobile coupler (C—3) of this invention.

Constitution of BM Layer

Prepared similarly as in BH emulsion layer, except for changing the high sensitivity blue-sensitive silver iodobromide emulsion to a medium sensitivity blue-sensitive silver iodobromide emulsion.

Sample 7 This invention

Prepared similarly as in Sample 2, except for replacing 50 mole % of the Yellow coupler in BH emulsion layer in Sample 2 with the mobile coupler (C—3) of this invention, 50 mole % of the Magenta coupler in GH emulsion with the mobile coupler (C—18) of this invention and 50 mole % of the Cyan coupler in RH emulsion layer with the mobile coupler (C—27) of this invention.

Sample 8 This invention

Prepared similarly as in Sample 7, but, in addition, 50 mole % of the silver iodobromide grains contained in the GH emulsion layer were replaced with monodispersed core-shell type emulsion. This silver iodobromide grains has a distribution of 12% and an average grain size of 1.4 μm.

Sample 9 This invention

Prepared similarly as in Sample 8, but, in addition, for respective emulsion layers of BH and RH each 50 mole % of silver iodobromide grains were changed to monodispersed core-shell type emulsions.

After giving neutral exposure to each of these samples through an optical wedge, each sample was processed according to the following processing steps to obtain a dye image.

The characteristic values obtained are shown in Table 1 below.

| Processing (38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing | 3 minutes 15 seconds |
| Stabilization | 1 minute 30 seconds |
| Drying | |

The following processing solutions were used in the respective processing steps:

| | |
|---|---|
| [Composition of color developing solution] | |
| 4-Amino-3-methyl-N—ethyl-N—(β-hydroxyethyl)-aniline.sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter with water. | |
| [Composition of bleaching solution] | |
| Ferric ammonium salt of ethylenediamine-tetraacetic acid | 100.0 g |
| Diammonium salt of ethylenediamine-tetraacetic acid | 10.0 g |
| Ammonium bromide | 150.0 g |
| Glacial acetic acid | 10.0 ml |
| Made up to 1 liter with water and adjusted to pH 6.0 with aqueous ammonia | |
| [Composition of fixing solution] | |
| Ammonium thiosulfate | 175.0 g |
| Anhydrous sodium sulfite | 8.6 g |
| Sodium metasulfite | 2.3 g |
| Made up to 1 liter with water and adjusted to pH 6.0 with acetic acid | |
| [Composition of stabilizing solution] | |
| Formalin (37% aqueous solution) | 1.5 ml |
| Konidax (available from Konishiroku Photo Industry Co., Ltd.) | 7.5 ml |
| Made up to 1 liter with water. | |

TABLE 1

| | | Comparative Sample | | | | This invention | | | | |
|---|---|---|---|---|---|---|---|---|---|---|
| | | Sample No. | | | | | | | | |
| | | 1 | 2 | 3 | 4 | 5 | 6 | 7 | 8 | 9 |
| B | Relative sensitivity | 100 | 101 | 101 | 102 | 101 | 101 | 100 | 100 | 134 |
| | MTF | 67 | 66 | 66 | 67 | 66 | 65 | 65 | 65 | 78 |
| | RMS | 68 | 65 | 65 | 66 | 65 | 52 | 51 | 50 | 46 |
| G | Relative sensitivity | 100 | 118 | 118 | 119 | 118 | 118 | 118 | 175 | 186 |
| | MTF | 37 | 38 | 37 | 35 | 36 | 36 | 37 | 50 | 55 |
| | RMS | 44 | 45 | 38 | 28 | 38 | 44 | 34 | 31 | 28 |
| R | Relative sensitivity | 100 | 118 | 120 | 121 | 122 | 120 | 119 | 120 | 195 |
| | MTF | 31 | 32 | 31 | 31 | 31 | 32 | 30 | 30 | 42 |
| | RMS | 49 | 48 | 48 | 47 | 40 | 48 | 37 | 37 | 31 |

Note 1 B, G and R are measured values for blue, green and red lights, respectively.

Note 2 Sensitivity is shown as the value relative to the value of Sample No. 1 as 100.

Note 3 Detection of improved effect of image was conducted by determining MTF (Modulation Transfer Function) and comparing the greatness of MTF at a space frequency of 30 lines/min.

Note 4 RMS: shown in terms of 1000-fold value of standard deviation of fluctuation in density values which occur during scanning by means of a microdensitometer with a scanning orifice diameter of 25μ at a dye image density of Dmin+0.8.

As apparently seen from Table 1, as compared with Comparative samples (No. 1 and No. 2), the samples of this invention (No. 3–No. 9) can be improved in graininess by unfocusing of dye images, without substantial deterioration of sharpness. Thus, it can be seen that graininess can be improved in this invention without substantial deterioration of sharpness, while maintaining high sensitivity. Further, the effect can be understood to be the greatest in the case of the core-shell type monodispersed emulsion as Samples No. 8 and No. 9.

Sample 2

Fourteen (14) kinds of samples of Sample No. 3'14 9' and No. 3"-9" were prepared similarly as in preparation of Samples No. 3-No. 9, except for replacing the mobile coupler (C—3) of this invention with (C—4) or (C—15), the mobile coupler (C—18) of this invention with (C—17) or (C—19) and the mobile coupler (C—27) of this invention with (C—22) or (C—26), respectively, in the samples. For respective samples, the photographic performance was examined in the same manner as in Example 1. As the result, good results were obtained which were substantially the same as those corresponding to Samples No. 3-9.

What is claimed is:

1. A light-sensitive silver halide color photographic material having red-sensitive, green-sensitive and blue-sensitive emulsion layers, each layer consisting of two or more layers with different sensitivities on a support, wherein the layers are constituted so as to satisfy the following requirements (A), (B), (C) and (D):

(A) of the respective emulsion layers having the highest sensitivities among the said red-sensitive, green-sensitive and blue-sensitive emulsion layers, the highest sensitivity blue-sensitive emulsion layer is provided on the side farthest from the support;

(B) at least the said highest sensitivity red-sensitive emulsion layer and the highest sensitivity green-sensitive emulsion layer are provided between the said highest blue-sensitive emulsion layer and a blue-sensitive emulsion layer with lower sensitivity;

(C) none of the respective red-sensitive, green-sensitive and blue-sensitive emulsion layers having the lowest sensitivities exists on the side farther than said blue-sensitive emulsion layer with lower sensitivity from the support; and (D) contained in at least one layer of said high sensitivity red-sensitive, green-sensitive and blue-sensitive layers, is a diffusion-resistant compound capable of forming a mobile dye through the coupling reaction with the oxidized product of a chromogenic developing agent.

2. The light-sensitive silver halide color photographic material according to claim 1, wherein the layer constitution of the photographic material comprises, from the sides nearer to the support, respective low sensitivity red-sensitive, green-sensitive and blue-sensitive emulsion layers, respective high sensitivity red-sensitive, green-sensitive and blue-sensitive emulsion layers.

3. The light-sensitive silver halide color photographic material according to claim 2, wherein a medium sensitivity green-sensitive emulsion layer is further positioned between the high sensitivity red-sensitive emulsion layer and the high sensitivity green-sensitive emulsion layer.

4. The light-sensitive silver halide color photographic material according to claim 2, wherein the low sensitivity green-sensitivity emulsion layer is separated into two layers, which are made to have low sensitivity and medium sensitivity from the side nearer to the support, respectively.

5. The light-sensitive silver halide color photographic material according to claim 2, wherein respective medium sensitivity red-sensitive and green-sensitive emulsion layers are further positioned from the side nearer to the support between the low sensitivity blue-sensitive emulsion layer and the high sensitivity red-sensitive emulsion layer.

6. The light-sensitive silver halide color photographic material according to claim 2, wherein respective medium sensitivity red-sensitive, green-sensitive and blue-sensitive emulsion layers are further positioned from the side nearer to the support between the low sensitivity blue-sensitive emulsion layer and the high sensitivity red-sensitive emulsion layer.

7. The light-sensitive silver halide color photographic material according to claim 2, wherein the respective high sensitivity red-sensitive, green-sensitive and blue-sensitive emulsion layers are separated into two layers, which are made to have medium sensitivity and high sensitivity emulsion layers from the side nearer to the support, respectively.

8. The light-sensitive silver halide color photographic material according to claim 2, wherein the respective high sensitivity red-sensitive and green-sensitive layers are separated into two layers, which are made to have medium sensitivity and high sensitivity emulsion layers from the side nearer to the support, respectively.

9. The light-sensitive silver halide color photographic material according to claim 2, wherein a medium sensitivity blue-sensitive emulsion layer is further positioned between the low sensitivity blue-sensitivity emulsion layer and the high sensitivity red-sensitive emulsion layer.

10. The light-sensitive silver halide color photographic material according to claim 2, wherein the respective low sensitivity red-sensitive and green-sensitive emulsion layers are separated into two layers, which are made to have low sensitivity and medium sensitivity emulsion layers from the side nearer to the support, respectively.

11. The light-sensitive silver halide color photographic material according to claim 2, wherein the respective low sensitivity red-sensitive, green-sensitive and blue-sensitive emulsion layers are separated into two layers, which are made to have low sensitivity and medium sensitivity emulsion layers from the side nearer to the support, respectively.

12. The light-sensitive silver halide color photographic material according to claim 2, wherein the low sensitivity red-sensitive emulsion layer is separated into two layers, which are made to have low sensitivity and medium sensitivity emulsion layers from the side nearer to the support, respectively.

13. The light-sensitive silver halide color photographic material according to claim 1, wherein the layer constitution of the photographic material comprises, from the sides nearer to the support, respective low sensitivity red-sensitive, green-sensitive and blue-sensitive emulsion layers, respective high sensitivity green-sensitive, red-sensitive and blue-sensitive emulsion layers.

14. The light-sensitive silver halide color photographic material according to claim 1, wherein a monodispersed silver halide emulsion is contained in at least one layer selected from the group consisting of the red-sensitive emulsion layer, green-sensitive emulsion layer and blue-sensitive emulsion layer in an amount of at least 50% by weight as a silver halide quantity.

15. The light-sensitive silver halide color photographic material according to claim 14, wherein said monodispersed silver halide emulsion is silver halide grains having a value of a standard deviation S of a grain size distribution of silver halide grains as defined by the following formula diveded by an average grain size $\bar{r}$ of 0.20 or less:

$$S = \sqrt{\frac{\Sigma(\bar{r} - r_i)^2 n_i}{\Sigma n_i}}$$

$$\bar{r} = \frac{\Sigma ni\, ri}{\Sigma ni}$$

wherein ri represents the grain size of individual silver halide grains and ni represents the number of silver halide grains having respective grain size.

16. The light-sensitive silver halide color photographic material according to claim 1, wherein said diffusion resistant compound is a mobile coupler having the following formula [I]:

Coup - Control group [I]
|
Ballast group wherein Coup is a coupler mother nucleus capable of forming a dye; Ballast group is a group which is bonded to the coupling position of said coupler mother nucleus and can be eliminated from Coup during the coupling reaction between said coupler and the oxidized product of a color developing agent, and the Ballast group has a size and a shape of molecule enough to make the coupler non-diffusive; and Control group is a group bonded to Coup at the non-coupling position for controlling the color forming dye formed through the coupling reaction between the coupler and the oxidized product of a chromogenic developing agent so that it is slightly mobile or completely diffusible.

17. The light-sensitive silver halide color photographic material according to claim 16, wherein said diffusion resistant compound is a yellow coupler represented by the following formula [II]:

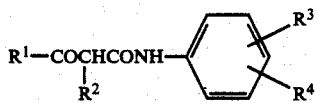

[II]

wherein $R^1$ represents an aryl group or an alkyl group; $R^2$ represents the ballast group; $R^3$ represents the control group; and $R^4$ represents a hydrogen atom, a halogen atom, an alkyl group, an alkoxy group or the control group.

18. The light-sensitive silver halide color photographic material according to claim 16, wherein said diffusion resistant compound is a cyan coupler represented by the following formula [III] or [IV]:

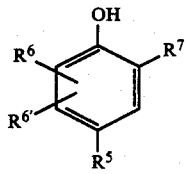

[III]

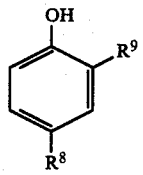

[IV]

wherein $R^5$ represents the ballast group; at least one of $R^6$, $R^{6'}$ and $R^7$ represents the control group, other two groups representing either identical or different hydrogen atoms, halogen atoms, alkyl groups, alkoxy groups, alkylamino groups or acylamide groups; $R^8$ represents the ballast group; and $R^9$ represents the control group.

19. The light-sensitive silver halide color photographic material according to claim 16, wherein said diffusion resistant compound is a magenta coupler represented by the following formula (V) or (VI):

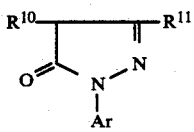

[V]

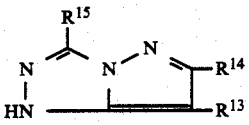

[VI]

wherein $R^{10}$ represents the ballast group; $R^{11}$ represents the control group; Ar represents an unsubstituted phenyl group or a phenyl group having at least one substituent selected from halogen atoms, alkyl groups, alkoxy groups, amino groups or the aforesaid control group; $R^{13}$ represents the ballast group; one of $R^{14}$ and $R^{15}$ represents the control group and the other represents a hydrogen atom, an alkyl group, an alkoxy group, an aryl group, an amino group or an acylamide group.

20. The light sensitive silver halide color photographic material according to claim 15 wherein said silver halide grains are core-shell type silver halide grains.

* * * * *